US009564672B2

(12) United States Patent
Burke et al.

(10) Patent No.: US 9,564,672 B2
(45) Date of Patent: Feb. 7, 2017

(54) LIGHTWEIGHT CAVITY FILTER STRUCTURE

(75) Inventors: Ian Burke, Lake Forest, CA (US); Jason Cook, Huntington Beach, CA (US); Ahmad Khanifar, Laguna Hills, CA (US)

(73) Assignee: Intel Corporation, Santa Clara, CA (US)

( * ) Notice: Subject to any disclaimer, the term of this patent is extended or adjusted under 35 U.S.C. 154(b) by 360 days.

(21) Appl. No.: 13/426,257

(22) Filed: Mar. 21, 2012

(65) Prior Publication Data

US 2012/0242425 A1 Sep. 27, 2012

Related U.S. Application Data

(60) Provisional application No. 61/466,312, filed on Mar. 22, 2011.

(51) Int. Cl.
*H01P 11/00* (2006.01)
*H01P 1/208* (2006.01)
(Continued)

(52) U.S. Cl.
CPC ..... *H01P 11/007* (2013.01); *C23C 18/1653* (2013.01); *C23C 18/1657* (2013.01);
(Continued)

(58) Field of Classification Search
CPC ..... H01P 1/202; H01P 1/205; H01P 1/2053; H01P 1/2056; H01P 1/208; H01P 7/06; H01P 7/065; H01P 11/008
(Continued)

(56) References Cited

U.S. PATENT DOCUMENTS 2,565,643 A * 8/1951 Baddour ..... 200/6 R
4,259,561 A * 3/1981 Roussy ..... H01P 7/06 219/693
(Continued)

FOREIGN PATENT DOCUMENTS

CN 1137842 A 12/1996
CN 102046710 A 5/2011
(Continued)

OTHER PUBLICATIONS

International Search Report and Written Opinion from International Search Authority for related PCT application serial No. PCT/US2012/057141, Feb. 5, 2013, 5 pp.
(Continued)

*Primary Examiner* — Benny Lee
*Assistant Examiner* — Gerald Stevens
(74) *Attorney, Agent, or Firm* — Schwegman Lundberg & Woessner, P.A.

(57) ABSTRACT

Embodiments provide a novel fabrication method and structure for reducing structural weight in radio frequency cavity filters and novel filter structure. The novel filter structure is fabricated by electroplating the required structure over a mold. The electrodeposited composite layer may be formed by several layers of metal or metal alloys with compensating thermal expansion coefficients. The first or the top layer is a high conductivity material or compound such as silver having a thickness of several times the skin-depth at the intended frequency of operation. The top layer provides the vital low loss performance and high Q-factor required for such filter structures while the subsequent compound layers provide the mechanical strength.

19 Claims, 12 Drawing Sheets

(51) Int. Cl.

| | |
|---|---|
| ***C23C 18/16*** | (2006.01) |
| ***C23C 28/02*** | (2006.01) |
| ***C25D 1/02*** | (2006.01) |
| ***C25D 7/00*** | (2006.01) |

(52) U.S. Cl.
CPC ..... *C23C 28/021* (2013.01); *C23C 28/023* (2013.01); *C25D 1/02* (2013.01); *C25D 7/00* (2013.01); *H01P 1/208* (2013.01); *H01P 11/008* (2013.01)

(58) Field of Classification Search
USPC .... 333/202, 206, 207, 222–234; 205/67, 78, 205/167
See application file for complete search history.

(56) References Cited

U.S. PATENT DOCUMENTS

| | | | | |
|---|---|---|---|---|
| 4,265,690 | A * | 5/1981 | Lowenhar | 156/161 |
| 4,523,162 | A * | 6/1985 | Johnson | 333/202 |
| 4,677,402 | A * | 6/1987 | Cesani | H01P 1/30 333/203 |
| 5,329,687 | A * | 7/1994 | Scott et al. | 29/527.2 |
| 5,894,250 | A | 4/1999 | Ravaska et al. | |
| 5,993,934 | A | 11/1999 | Reese et al. | |
| 6,036,815 | A | 3/2000 | Peterson et al. | |
| 6,148,221 | A * | 11/2000 | Ishikawa | H01L 39/128 257/E39.011 |
| 6,900,708 | B2 | 5/2005 | White et al. | |
| 7,471,172 | B2 | 12/2008 | Holst et al. | |
| 7,847,658 | B2 * | 12/2010 | Lyons | C08J 9/0066 333/202 |
| 9,312,594 | B2 | 4/2016 | Burke et al. | |
| 2001/0030587 | A1 | 10/2001 | Wulff | |
| 2009/0027403 | A1 | 1/2009 | Jung | |
| 2009/0302974 | A1 | 12/2009 | Lyons et al. | |
| 2010/0045406 | A1 | 2/2010 | Andreasson | |
| 2010/0328325 | A1 | 12/2010 | Sevigny et al. | |
| 2011/0030197 | A1 | 2/2011 | Lagrotta et al. | |
| 2012/0149464 | A1 | 6/2012 | Bone et al. | |
| 2013/0016025 | A1 | 1/2013 | Burke et al. | |

FOREIGN PATENT DOCUMENTS

| | | | |
|---|---|---|---|
| CN | 102214852 | A | 10/2011 |
| CN | 202977669 | U | 6/2013 |
| CN | 104521062 | A | 4/2015 |
| WO | WO-201097178 | A1 | 7/2012 |
| WO | WO-2013/141897 | A1 | 9/2013 |

OTHER PUBLICATIONS

"U.S. Appl. No. 13/626,700, Non Final Office Action mailed Apr. 14, 2015", 9 pgs.
"U.S. Appl. No. 13/626,700, Response filed Jul. 14, 2015 to Non Final Office Action mailed Apr. 14, 2015", 10 pgs.
"U.S. Appl. No. 13/626,700, Response to Restriction Requirement mailed Jan. 16, 2015", 8 pgs.
"U.S. Appl. No. 13/626,700, Restriction Requirement mailed Jan. 16, 2015", 8 pgs.
"European Application Serial No. 12871637.0, Office Action mailed Nov. 14, 2014", 1 pg.
"International Application Serial No. PCT/US2012/057141, International Preliminary Report on Patentability mailed Oct. 2, 2014", 10 pgs.
Harel, J. P., et al., "Foam technology for integration of millimetre-wave 3D functions", Electronics Letters Oct. 14, 1999 vol. 35 No. 21, (1999), 1853-1854.
Lohinetong, et al., "Surface Mounted Millimeter Waveguide Devices Based on Metallized Dielectric Foam or Plastic Materials", IEEE, (2005), 1409-1412.
Lohinetong, D., et al., "Microstrip To Surface Mounted Foam-Based Waveguide Transition for Ka-Band Filter Integration", IEEE 2004 4' International Conference on Microwave and Millimeter Wave Technology Proceedings, (2004), 899-902.
Mueller, Thomas, "SMD-type 42 GHz waveguide filter", IEEE MTT-S Digest; Weid-6, (2003), 1089-1093.
Person, Christian, et al., "Co-integration of filters and waveguide to microstrip transitions using the foam technology", 33rd European Microwave Conference—Munich 2003, (2003), 435-438.
"U.S. Appl. No, 13/626,700, Corrected Notice of Allowability mailed Dec. 15, 2015", 4 pgs.
"U.S. Appl. No. 13/626,700, Ex Parte Quayle Action mailed Sep. 8, 2015", (Sep. 8, 2015), 6 pgs.
"U.S. Appl. No, 13/626,700, Notice of Allowance mailed Nov. 25, 2015", 9 pgs.
"U.S. Appl. No. 13/626,700, Response filed Nov. 6, 2015 to Ex-Parte Quale Action mailed Sep. 8, 2015", 30 pgs.
"Chinese Application Serial No. 201280073379,8, Office Action mailed Feb. 1, 2016", W/ English Translation, 23 pgs.
"European Application Serial No. 12871637.0, Amendment filed Oct. 21, 2014", 11 pgs.
"European Application Serial No. 12871637.0, Extended European Search Report mailed Feb. 15, 2016", 12 pgs.
Liberatoscioli, S, et al., "Innovative manufacturing technology for RF Passive devices combining electroforming and CFRP application", IEEE MTT-S International Microwave Symposium Digest, (Jun. 2008), 743-746.
Ma, Z, et al., "Microwave cavity resonators using hard X-ray Lithography", Microwave and Optical Technology Letters 47(4), (Nov. 2005), 353-357.
Varlese, Steven J, "Performance Characterization of a Shape Memory Composite Mirror", Proceedings 0f Spie vol. 5899, (Aug. 18, 2005), 58990Y-58990Y-9.
Vicenti, A, et al., "Tailoring Expansion Coefficients of Laminates: A New General Optimal Approach Based upon the Polar-Genetic Method", 6th World Congresses of Structural and Multidisciplinary Optirnization9, (May 30, 2005), 10 pgs.

* cited by examiner

LIGHTWEIGHT CAVITY FILTER STRUCTURE

RELATED APPLICATION INFORMATION

The present application claims priority under 35 U.S.C. Section 119(e) to U.S. Provisional Patent Application Ser. No. 61/466,312 filed Mar. 22, 2011, the disclosure of which is incorporated herein by reference in its entirety.

BACKGROUND OF THE INVENTION

1. Field of the Invention

This present invention is related in general to methods and structures for filtering radio waves. More particularly, the invention is directed to methods and structures for fabricating lightweight cavity resonator filters.

2. Description of the Prior Art and Related Background Information

Embodiments disclosed herein are related to a family of electrical circuits generally referred to as cavity resonator filters, which are used in radio frequency transceiver chains. Cavity resonator filters aid with receiving and transmitting radio waves in selected frequency bands. Typically, such filter structures are formed by coupling a number of coaxial cavity resonators or dielectrically loaded cavity resonators via capacitors, transformers, or by apertures in walls separating the resonators. It is noticeable that, unlike the general trend in electric and electronic devices where in recent years significant miniaturization has been achieved, efforts to downsize radio frequency ("RF") filters have been inhibited. This is primarily due to the fact that, to meet low loss and high selectivity requirements, air-cavity filters with dimensions approaching a fraction of free space wavelength are required. U.S. Pat. No. 5,894,250 is an example of such a filter implementation. FIG. 3 depicts a coaxial cavity filter that is commonly realized in practice which can achieve the electrical performance requirements.

The pursuit of improving the RF bandwidth efficiency in cellular infrastructure has led to increasingly stringent filtering requirements at the RF front end. High selectivity and low insertion loss filters are in demand in order to conserve valuable frequency spectrum and enhance system DC to RF conversion efficiency. Filter structures with spurious-free performance are needed to meet the out-of-band requirements. Furthermore, it is also desired that such filters have both low costs and small form factors to fit into compact radio transceivers units, often deployed remotely for coverage optimizations. The size and weight constraints are even more exasperated by the advent of multiple-input multiple-output ("MIMO") transceivers. Depending on implementation in a MIMO system, the number of duplexer filters may range from two to eight times that of a single-input single-output ("SISO") unit, all of which requires smaller and lighter filter structures. The desire for smaller size conflicts with the electrical performance requirement that resonators achieve very high unloaded Q-factor, which demands larger resonating elements.

An RF bandpass filter can achieve a higher selectivity by increasing the number of poles, i.e., the number of resonators. However, because the quality factor of the resonators is finite, the passband insertion loss of the filter increases as the number of resonators is increased. Therefore, there is always a trade-off between the selectivity and the passband insertion loss. On the other hand, for specified filter selectivity, certain types of filter characteristics that not only meet the selectivity requirement, but also result in a minimum passband insertion loss, are required. One such filter with these characteristics is the elliptic function response filter. Notable progress has been made on improving the size, and the in-band and out-of-band performance of the filters. However the size and the associated weight reduction of such structures present formidable challenges in remote radio head products.

FIG. 1 depicts the equivalent lumped element circuit schematic of a bandpass filter with capacitive coupling. FIG. 2 shows the distributed implementation where combinations of lumped and distributed components are being used. This filter structure is known as a combline filter. In this structure, the coaxial resonators are formed by a section of transmission line, the electrical length of which is typically between 30° and 90°. The electrical length of distributed lines dictates the position of spurious bandpass response of the filter in its stop band. The employment of the lumped capacitive elements allows for tunability but the mixed lumped distributed structure improves the spurious response suppression. For these reasons, the combline filter structure is very popular in practice. The implementation of the elliptic response is aided by the application of cross-coupling between the resonators.

Most cellular standards operate in Frequency Division Duplex ("FDD") mode. This means that for each transceiver, there are a pair of filters forming a duplexer filter structure. As mentioned earlier, more recent architectures, such as MIMO systems, incorporate several duplexers packaged in a single radio enclosure. The relatively large-sized cavity resonators coupled with expected large filter selectivity means that the duplexer(s) practically occupies a large space and forms the main mass of a remote radio head ("RRH") unit. This is an insurmountable design challenge particularly in the sub-gigahertz bands that are allocated to mobile telephony services.

The forgoing discussion defines the mechanical structure of a typical filter. The structure is normally machined or cast out of aluminum. In order to reduce the weight, the excess metal is machined off from the main body of the structure. This arrangement is shown in FIG. 3.

Accordingly, a need exists to reduce the weight of cavity resonator filter structures.

SUMMARY OF THE INVENTION

In a first aspect, the present invention provides a method for forming a lightweight cavity filter structure comprising providing a mold having a contoured surface inversely shaped to that of a cavity filter structure, and depositing one or more layers of metal onto the mold, the one or more layers of the metal having a total thickness on the order of one to several times the skin depth associated with the operating radio frequency of the cavity filter structure. The method further comprises depositing one or more layers of laminate onto the layer of metal, where the one or more layers of laminate is adapted for providing mechanical support to the cavity filter structure, and separating the one or more layers of metal from the mold to provide the cavity filter structure.

In a preferred embodiment, the one or more layers of laminate comprise multiple layers of laminate where each layer of laminate has a thermal expansion coefficient opposite to that of an adjacent layer of laminate. The total thickness of the one or more layers of metal is preferably approximately 10 micrometers. The mold preferably comprises a conductive mold, and the depositing one or more layers of metal preferably comprises depositing a layer of metal employing an electroplating process. The mold may alternatively comprise an insulating mold, and the depositing one or more layers of metal further comprises depositing a first layer of metal employing an electro-less plating process, and depositing a second layer of metal employing an electro-plating process. The first layer of metal may preferably comprise copper and the second layer of metal may preferably comprise silver.

In another aspect, the present invention provides a cavity filter structure produced by a process as follows. The process comprises the steps of providing a mold having a contoured surface inversely shaped to that of a cavity filter structure, and depositing one or more layers of metal onto the mold, the one or more layers of the metal having a total thickness on the order of one to several times the skin depth associated with the operating radio frequency of the cavity filter structure. The process further comprises depositing one or more layers of laminate onto the layer of metal, where the one or more layers of laminate is adapted for providing mechanical support to the cavity filter structure, and separating the one or more layers of metal from the mold to provide the cavity filter structure.

In a preferred embodiment, the one or more layers of laminate preferably comprise multiple layers of laminate where each layer of laminate has a thermal expansion coefficient opposite to that of an adjacent layer of laminate. The total thickness of the one or more layers of metal is preferably approximately 10 micrometers. The mold preferably comprises a conductive mold, and the depositing one or more layers of metal preferably comprises depositing a layer of metal employing an electroplating process. The mold may alternatively comprise an insulating mold, and the depositing one or more layers of metal further comprises depositing a first layer of metal employing an electro-less plating process, and depositing a second layer of metal employing an electro-plating process.

In another aspect, the present invention provides a lightweight cavity resonator filter, comprising a metal shell having an exposed contoured surface of a cavity filter structure, the metal shell having a thickness on the general order of magnitude of the skin depth associated with the operating radio frequency of the cavity filter structure, and multiple layers of laminate coupled to the metal shell, where each layer of laminate has a thermal expansion coefficient opposite to that of an adjacent layer of laminate where in some embodiments one of the expansion coefficients is positive and the other expansion coefficient is negative.

In another aspect, the present invention provides a method for forming a lightweight cavity filter structure comprising providing an insulated housing having a contoured surface of a cavity filter structure, depositing a first layer of metal onto the insulated housing employing an electro-less plating process, and depositing a second layer of metal onto the first layer of metal employing an electroplating process. The total thickness of the first and second layers of metal is on the general order of magnitude of the skin depth associated with the operating radio frequency of the cavity filter structure.

In a preferred embodiment, the total thickness of the first and second layers of metal is approximately 10 micrometers. The insulated housing may preferably comprise polystyrene. The first layer of metal may preferably comprise copper and the second layer of metal may preferably comprise silver.

In another aspect, the present invention provides a cavity filter structure produced by a process comprising the steps of providing an insulated housing having a contoured surface of a cavity filter structure, depositing a first layer of metal onto the insulated housing employing an electro-less plating process, and depositing a second layer of metal onto the first layer of metal employing an electroplating process. The total thickness of the first and second layers of metal is on the general order of magnitude of the skin depth associated with the operating radio frequency of the cavity filter structure.

In a preferred embodiment, the total thickness of the first and second layers of metal is approximately 10 micrometers. The insulated housing may preferably comprise polystyrene. The first layer of metal may preferably comprise copper and the second layer of metal may preferably comprise silver.

Further features and aspects of the invention are set out in the following detailed description.

DETAILED DESCRIPTION OF THE INVENTION

Figure 1:
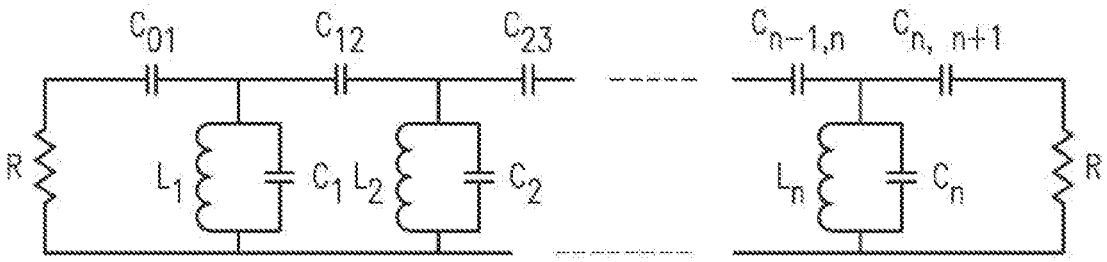
FIG. 1 (RELATED ART)
FIG. 1 is a schematic diagram of a lumped circuit having a capacitive coupled filter structure.
Figure 2:
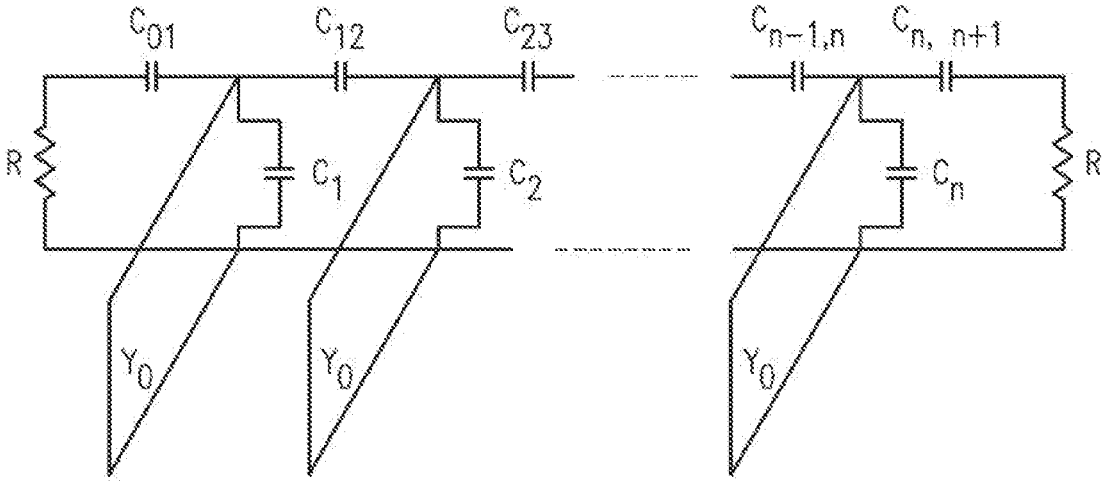
FIG. 2 (RELATED ART)
FIG. 2 is a schematic diagram of a lumped distributed RF filter.
Figure 3:
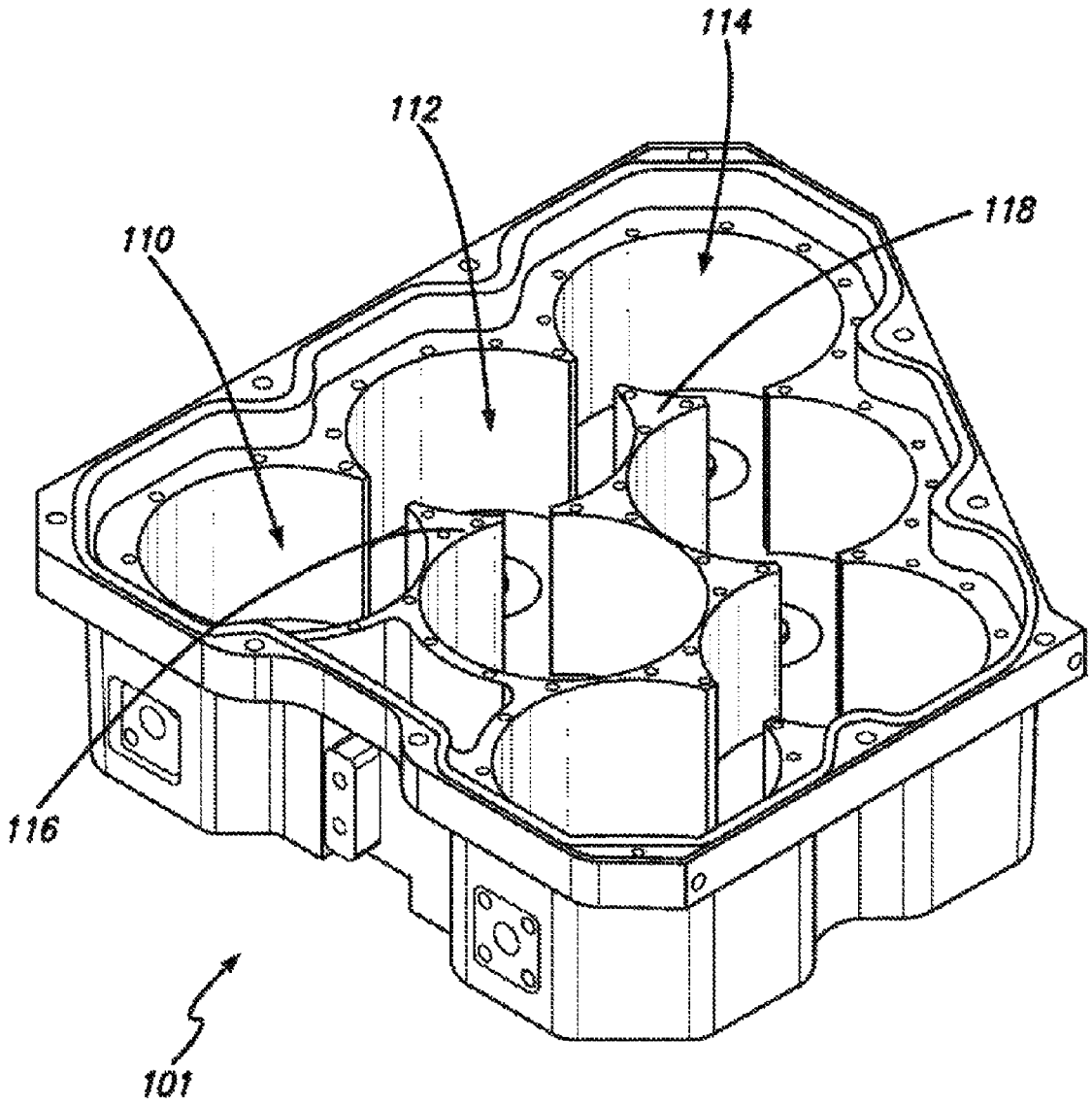
FIG. 3 (PRIOR ART)
FIG. 3 is a top, perspective view of a typical machined or cast aluminum combline duplexer filter structure as fabricated.

The mechanical structure of a conventional cavity based filter/duplexer housing 101 shown in FIG. 3 would have excessive weight. This is due to its massive and bulky resonator structure forming the cavity walls such as of the walls of cavities 110, 112, and 114 and partitions such as 116 and 118 between various compartments. The main embodiments disclosed herein relate to a manufacturing system and method that reduces the weight of such filter structures.

Within this disclosure, reference to various metal deposition processes including electro-less deposition and electroplating will be used as specific examples of implementations in one or more embodiments. As used herein and consistent with well known terminology in the art, electroless plating generally refers to a plating process which occurs without the use of external electrical power. Electroplating generally refers to a process which uses an electrical current to deposit material on a conductive object. However, the use of the these specific plating processes should not be taken as being limited in nature as the methods disclosed herein may be practiced with other metal deposition techniques known in the art. Furthermore, various intermediate processing steps know in the art such as, but not limited to, pretreatment, cleaning, surface preparation, masking, and the use of additional layers to facilitate separation or adhesion between adjacent layers may not have been explicitly disclosed for the purposes of clarity but may be employed in one or more embodiments.

Moreover, as used throughout this disclosure, the various cross-sectional views of the layered structures during the fabrication process and the resulting cavity filter structures are representations to illustrate the cross-sectional views and may not necessarily be to scale.

Embodiments relate to novel approaches for the design and fabrication of filters similar, but not limited to the structures described herein and above. Embodiments accordingly also include improved filter structures. The electrical performance of filter structures like those discussed above is very much dependent on the electrical properties of the surface material. Thus, while the surface losses are critical, the cavity wall thickness is of less significance to the extent that, while it helps achieve the desired mechanical rigidity, it is responsible for a disproportionate weight of the finished product. Therefore, in order to reduce the weight of the filter structure, the cavity wall density would need to be reduced substantially. This is to say that the mass per unit volume of the filter structure can be reduced considerably if the filter structure is formed by a controlled electro-deposition process. Details of this process will be discussed in some detail in following sections.

Embodiments provide a method and apparatus for low cost fabrication of a single or multi-mode cavity filter leading to a lightweight structure. Before a detailed discussion of one or more embodiments is presented, the relevant electrical theory will be described first.

It is well known to those with ordinary skill in the art that an AC signal penetrates into a conductor by a limited amount, normally penetrating by only a few skin depths. The skin depth by definition is defined as the depth below the surface of the conductor at which the current density has fallen to 1/e (i.e., about 0.37) of the current density. In other words, the electrical energy conduction role of the conductor is restricted to a very small depth from its surface. Therefore, the rest of the body of the conductor, and in the case of a cavity resonator, the bulk of the wall, does not contribute to the conduction.

The general formulae for calculating skin depth is given in equation (1)

$$\sigma = \sqrt{\frac{2\cdot\rho}{2\pi\cdot f\cdot\mu_R\cdot\mu_0}} \cong 503\sqrt{\frac{\rho}{\mu_R\cdot f}} \tag{1}$$

where $\rho$ is resistivity (Ohm-meters), f=frequency (Hz), and $\mu_0=4\pi\times10^7$.

From equation (1) it is evident that the skin depth is inversely proportional to signal frequency. At RF and microwave frequencies, the current only penetrates the wave-guiding walls by a few skin depths. The skin depth for a silver plated conductor supporting a signal at 1 GHz is 2.01 μm. For copper the figure is very close (2.48 μm). Hence while the actual wave-guiding walls are a few millimeters thick, the required thickness of the electrical wall is in the order of 10 μm.

Based on the previous discussions, the electrical performance of the filter structure and, indeed, any conducting structure supporting radio frequency signal can have a much reduced conductor thickness without an impact on their electrical characteristics (such as resonator Q-factors and transmission coefficients).

Embodiments are based on utilizing this property of an electrical conductor. The conventional method of manufacturing cavity filters relies on machining or casting a solid bulk of aluminum or copper and plating the conducting surfaces by electroplating copper or silver. A typical cavity filter is constructed using a structural base metal (e.g., aluminum, steel, invar etc.) plated with copper followed by silver. The plated layer is normally several skin-depths thick. The bulk of the structure serves as a structural support providing mechanical rigidity and thermal stability. It is of course possible to cast the filter structure and electroplate subsequently to achieve the same end result.

One or more embodiments provide a fabrication method in which the filter structure is formed by electroplating over a mold or a former that is a mirror image of the cavity structure(s). This can be achieved by machining or casting a former out of a metal structure that serves as the cathode in the electroplating process. The plated layer is several skin-depths thick. Beyond what is required to satisfy the electrical conductions, an additional plating laminate will improve the mechanical strength at the expense of added weight. The electroplated cavity structure can include the coaxial resonator, or provision for bolt in resonators (either coaxial or dielectric).

Figure 4A:
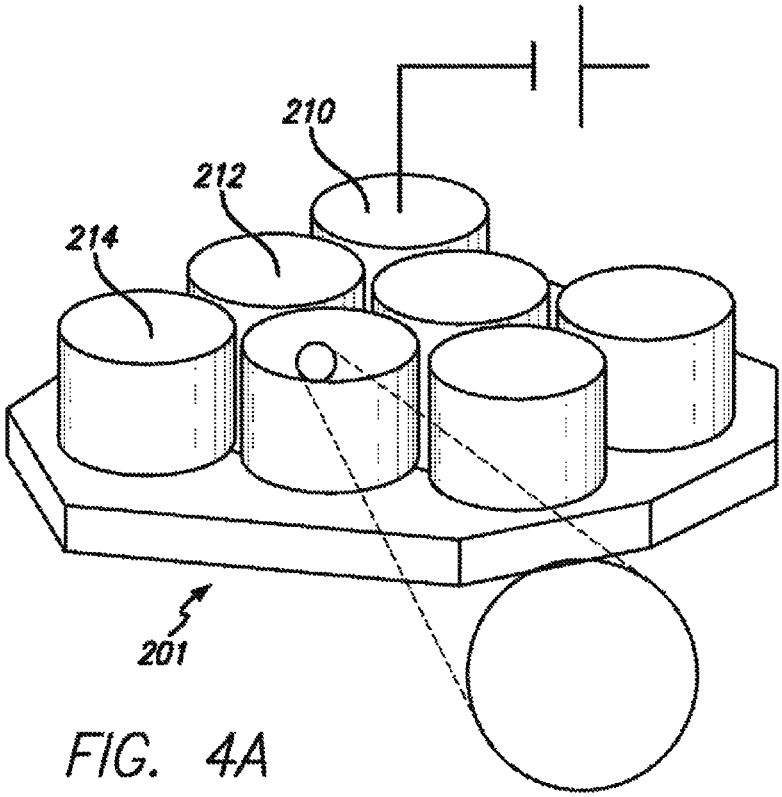
FIG. 4A is a top, perspective view of a metal mold used for the fabrication of a cavity filter structure in an embodiment.

FIGS. 4A-4D depict an exemplary apparatus and the structures at various steps in the fabrication process. FIG. 4A illustrates a metal mold 201 used for the fabrication of a cavity filter in an embodiment. The mold 201 has a contoured surface having a shape inverse to that of a cavity filter structure 230 shown in FIG. 4G. In general, the fabrication process comprises depositing materials onto the mold 210 and then separating the deposited materials from the mold 210 to result in the desired cavity filter structure 230. For example, the mold 201 has three cylinders 210, 212, and 214 which have an inverse shape to the cavities 240, 242, and 244 of cavity filter 230 shown in FIG. 4G. The metal mold 201 may be coupled to a voltage potential and placed in an electroplating bath which enables metal to be electroplated onto the metal mold 201. Cutaway, cross-sectional views of the structure as built are presented in FIGS. 4B-4G.

Figure 4B:
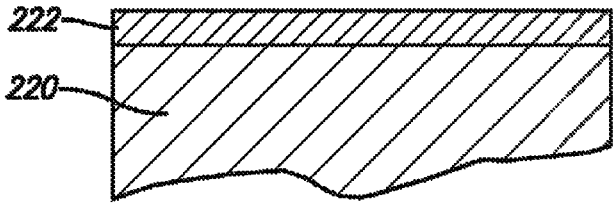
FIG. 4B is a representation of a cross-sectional view depicting a layer of electroplated metal deposited on a metal mold.
Figure 4C:
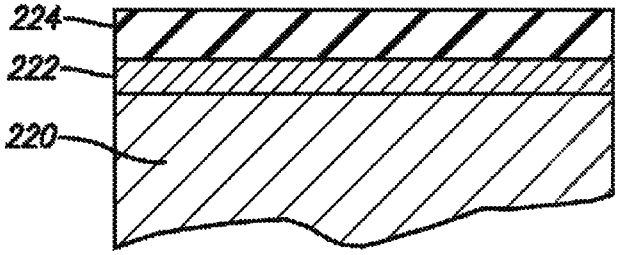
FIG. 4C is a representation of a cross-sectional view depicting a layer of laminate applied to the surface of the electroplated metal.

FIG. 4B illustrates an exemplary cross-sectional view depicting the resulting layer of electroplated metal 222 deposited on a metal mold 220. As depicted in FIG. 4C, a laminate 224 may be applied to the electroplated metal 222 to provide additional mechanical rigidity. The laminate 224 may comprise conducting or insulating materials in one or more embodiments. Examples of conducting materials may include metals and metal alloys.

Figure 4D:
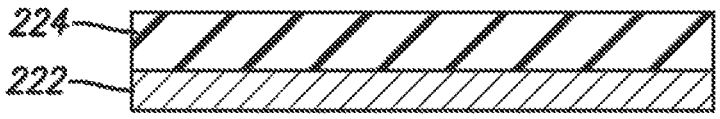
FIG. 4D is a representation of a cross-sectional view of the electroplated metal and laminate after the metal mold has been removed in an embodiment.

The electro-plated metal 222 may then be separated from the metal mold 220 to form a shell similar to that shown in cavity filter 230 comprising the electro-plated metal 222 and the laminate 224. While not explicitly described above for the purposes of clarity, additional steps may be employed to enable the separation of the electro-plated metal 222 from the mold 220. Such additional steps may include coating the mold 220 with a sacrificial layer which may be etched, liquefied, or dissolved to facilitate the separation of the electroplated metal 222 from the mold 220. FIG. 4D depicts a cross-sectional view of the electroplated metal 222 and the laminate 224 after the metal mold 220 has been separated from the electroplated metal 222 in an embodiment.

One or more embodiments provide a method of depositing several different layers with opposing thermal expansion rate to prevent the undesirable thermal expansion of the cavity dimensions.

Figure 4E:
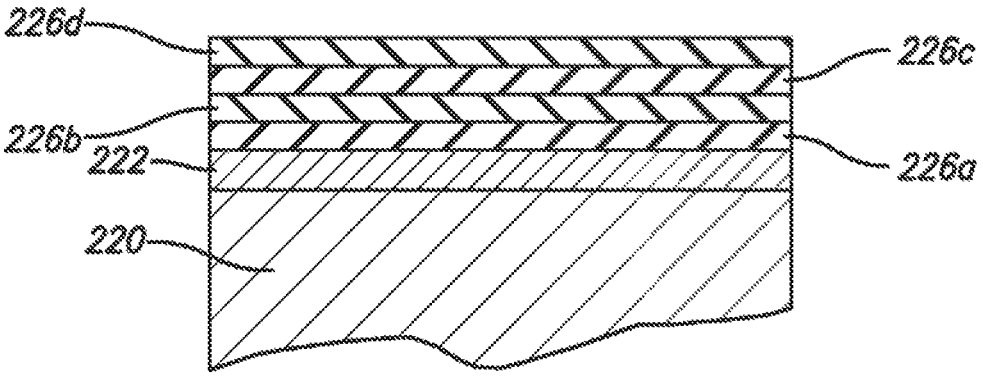
FIG. 4E is a representation of a cross-sectional view depicting multiple layers of laminate applied to the surface of the electroplated metal.
Figure 4F:
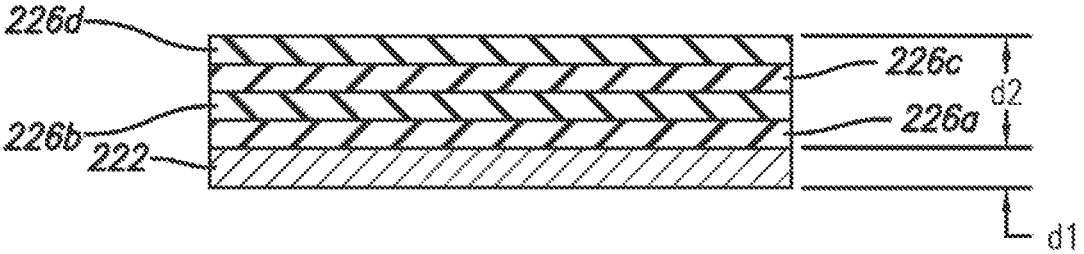
FIG. 4F is a representation of a cross-sectional view depicting the electroplated metal and the multiple layers of laminate after the metal mold has been removed.
Figure 4G:
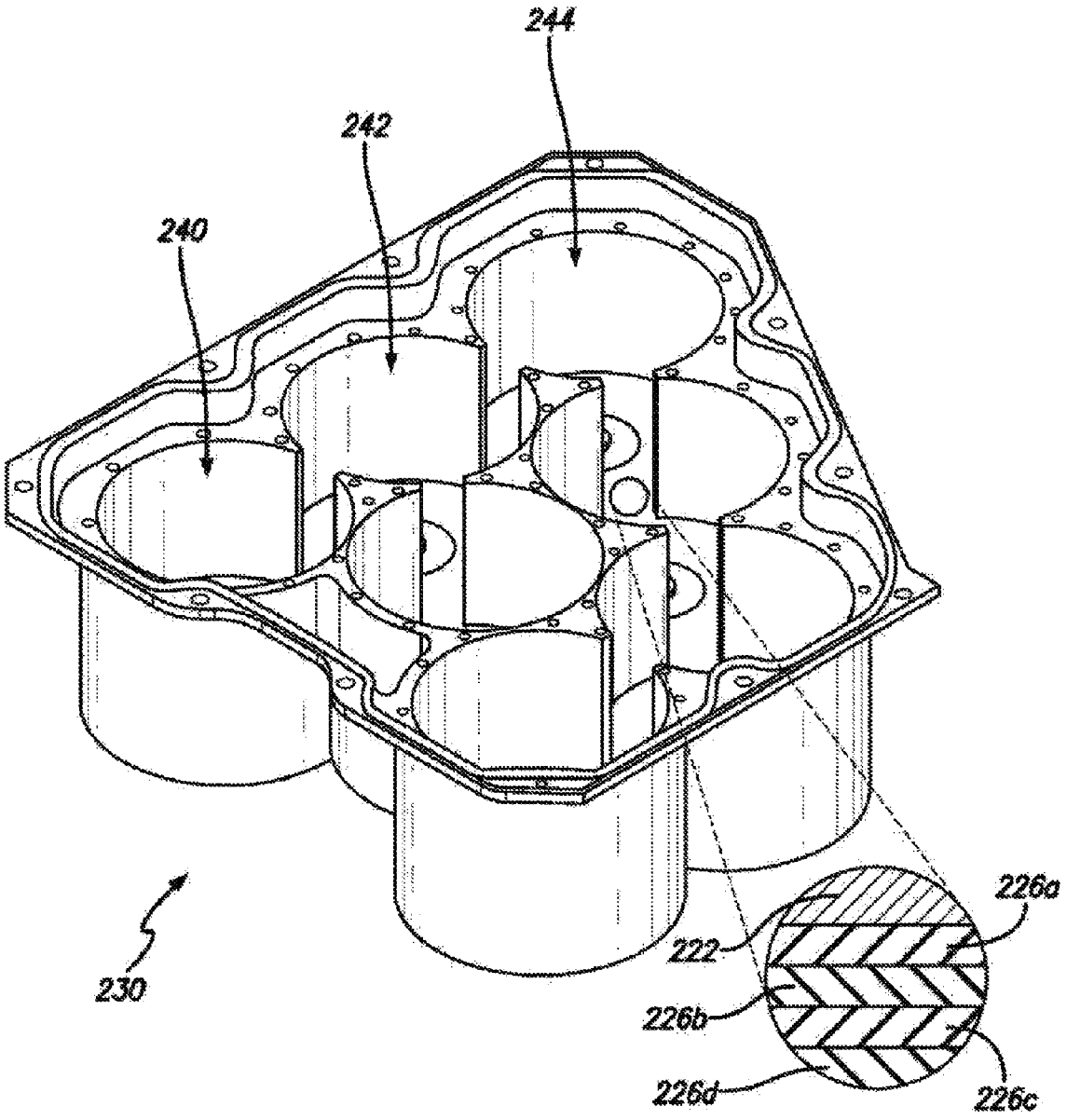
FIG. 4G is a top, perspective view of the resulting cavity filter structure.

FIG. 4E is a representation of a cross-sectional view depicting multiple layers of laminate 226*a*-226*d* applied to the surface of the electroplated metal 222. The layers of laminate may comprise metal, metal alloys, or insulating materials with compensating thermal expansion coefficients. For example, multiple layers of laminate may be employed such that each layer of the laminate has a thermal expansion coefficient opposite to that of an adjacent layer of laminate. As discussed above, the electroplated metal 222 may be separated from the mold 220. FIG. 4F illustrates a cross-sectional view depicting the electroplated metal 222 and the multiple layers of laminate 226*a*-226*d* after the metal mold 220 has been removed, and FIG. 4G depicts the final cavity filter structure 230.

As shown in FIG. 4F, the thickness of the electroplated metal 222 has a thickness represented as $d_1$ and the total thickness of the laminate layers is represented as $d_2$. The thickness of the electroplated metal 222 $d_1$ may be on the order of at least one to several times the skin depth associated with the operating radio frequency of the cavity filter structure in one or more embodiments. The thickness $d_1$ may be approximately 10 micrometers in an embodiment. The total thickness $d_2$ of the laminate 226*a*-226*d* is sufficient to provide mechanical rigidity to the electroplated metal 222 and may approximately one to several millimeters in an embodiment. The thickness $d_2$ of the laminate may be optimized based on the materials employed.

Another embodiment provides that the former may be made out of a metal of a non-metallic (insulator) material that is used as the cathode in the electroforming process but after an electro-less deposition process.

Figure 5A:
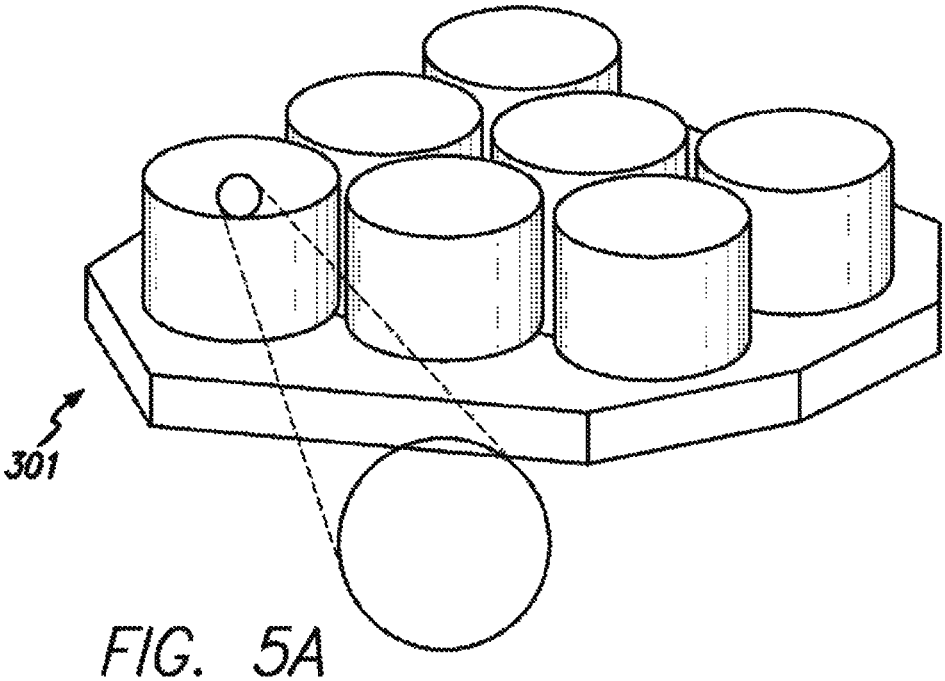
FIG. 5A is a top, perspective view of an insulating mold used for the fabrication of a cavity filter structure.
Figure 5B:
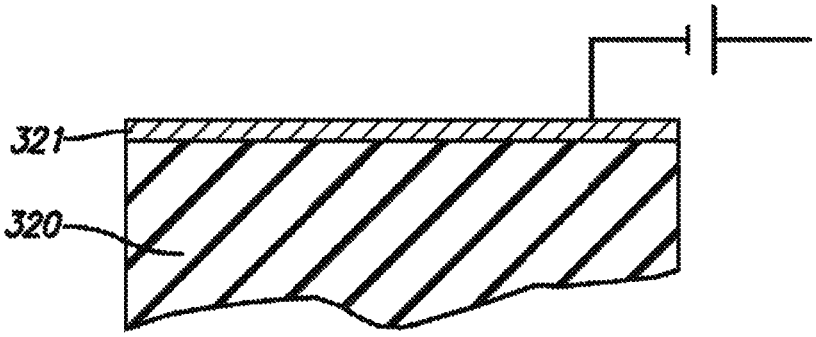
FIG. 5B is a representation of a cross-sectional view depicting a layer of electro-less deposited metal applied to the insulating mold.
Figure 5C:
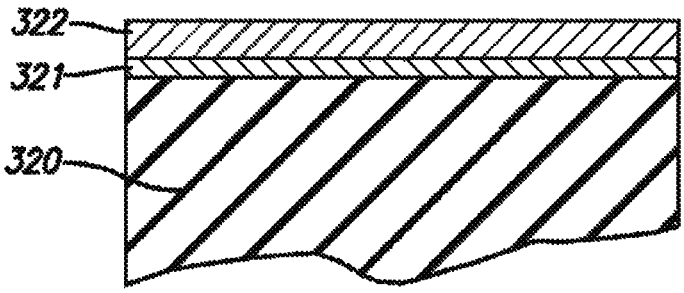
FIG. 5C is a representation of a cross-sectional view depicting a layer of electroplated metal deposited on the electro-less deposited metal.
Figure 5D:
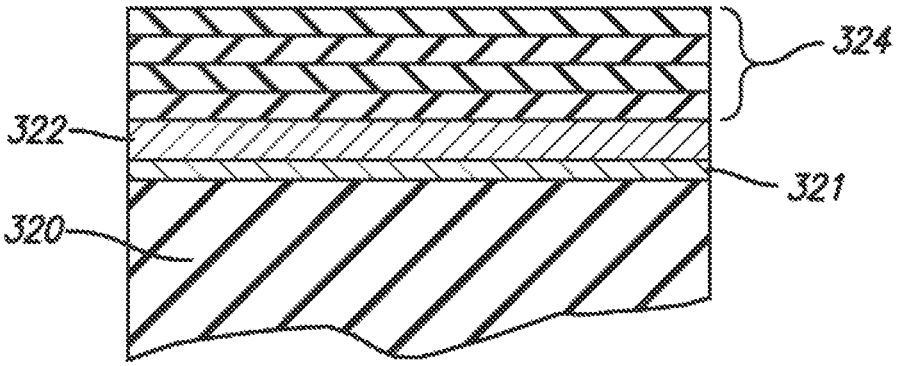
FIG. 5D is a representation of a cross-sectional view depicting one or more layers of laminate applied to the surface of the electroplated metal.
Figure 5E:
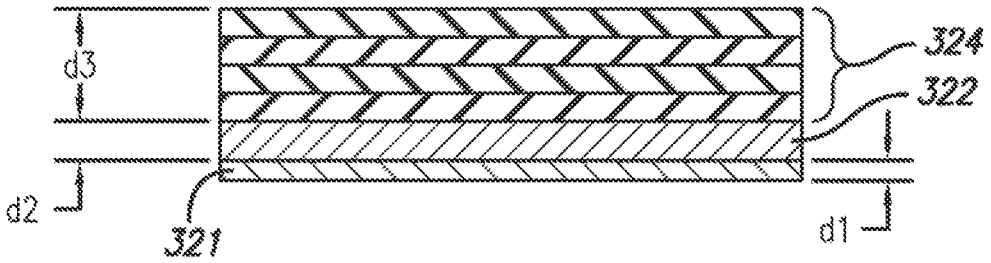
FIG. 5E is a representation of a cross-sectional view depicting the metal layers and the multiple layers of laminate after the insulating mold has been removed.
Figure 5F:
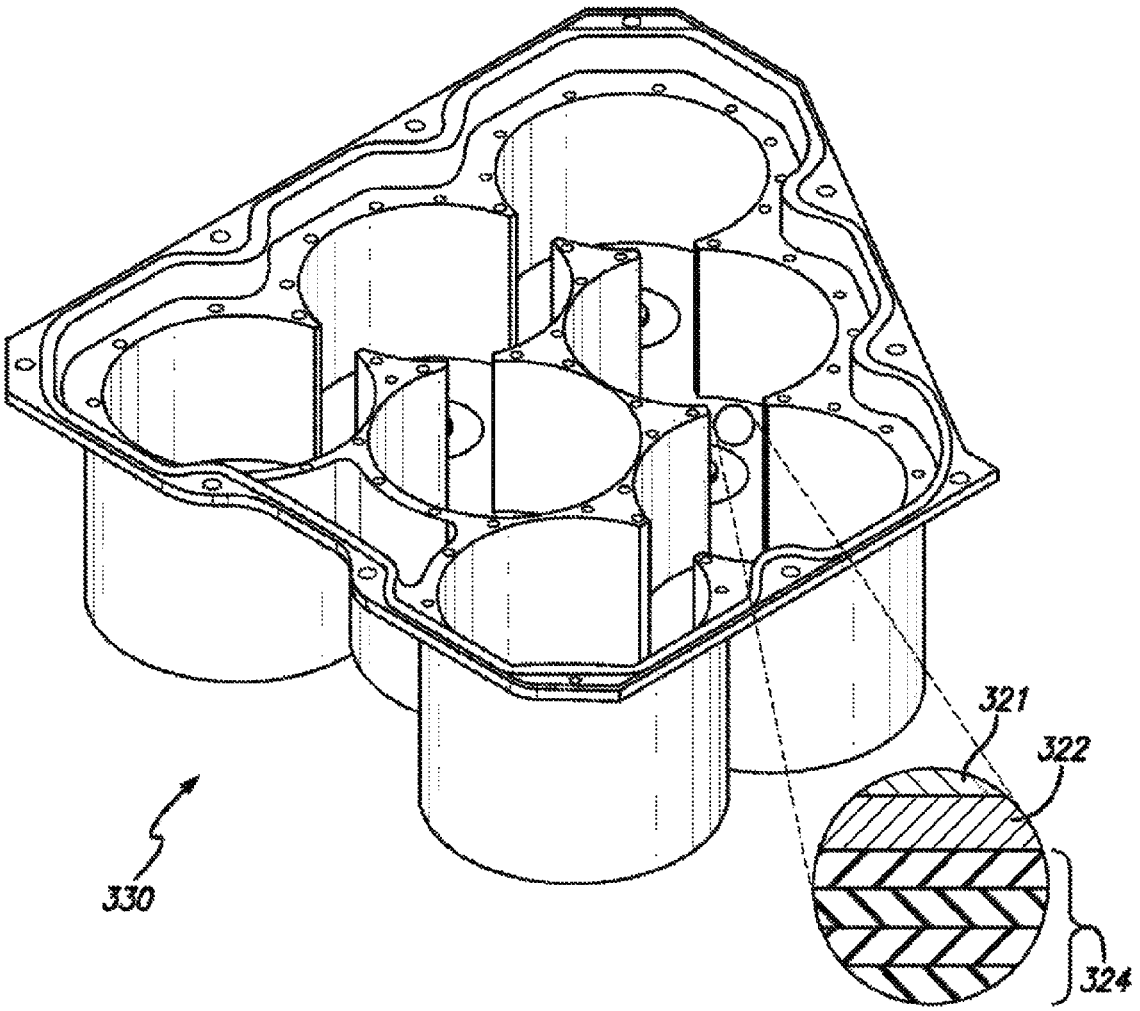
FIG. 5F is a top, perspective view of the resulting cavity filter structure.

FIGS. 5A-5E depict exemplary structure at various steps in an exemplary fabrication process, and FIG. 5F illustrates the resulting cavity filter structure 330. FIG. 5A illustrates an insulating mold 301 used for the fabrication of a cavity filter. The mold 301 has a contoured surface having a shape inverse to that of a cavity filter structure shown in FIG. 5F. An electro-less deposited metal 321 may be formed on mold 301 using known electro-less deposition processes. FIG. 5B depicts the layer of electro-less deposited metal 321 applied to the insulating mold 320. The electro-less deposited metal 321 may then be connected to a voltage potential and placed in an electro-plating bath as discussed above. FIG. 5C depicts a layer of electroplated metal 322 deposited on the electro-less deposited metal 321.

In an embodiment, one or layers of laminate 324 are applied to the electroplated metal 322 as illustrated in FIG. 5D. The layers of laminate may comprise metal, metal alloys, insulating materials, or metal alloys interspersed with insulating materials with compensating thermal expansion coefficients. For example, multiple layers of laminate may be employed such that each layer of the laminate has a thermal expansion coefficient opposite to that of an adjacent layer of laminate. The mold 320 may be separated from the electro-less deposited metal 321 as illustrated in FIG. 5E and as discussed above. The final cavity filter structure 330 is shown in FIG. 5F.

As shown in FIG. 5E, the electro-less deposited metal has a thickness represented as $d_1$, electroplated metal 322 has a thickness represented as $d_2$ and the total thickness of the laminate layers is represented as $d_3$. The thickness $d_1$ may be in the range of a fraction of micrometer to several micrometers in an embodiment. The thickness $d_2$ may be in the range of a fraction of a micrometer to several micrometers in an embodiment. The total thickness of the electro less metal 321 and the electroplated metal 322 $d_2$ (i.e., $d_1+d_2$) may be on the order of at least one to several times the skin depth associated with the operating radio frequency of the cavity filter structure in one or more embodiments and may be approximately 10 micrometers in an embodiment. The total thickness $d_3$ of the laminate 324 is sufficient to provide mechanical rigidity to the electro-less deposited metal 321 and the electroplated metal 322 and may be approximately one to several millimeters in an embodiment.

In an embodiment, yet another fabrication method is to mold the actual filter structure (the negative of what is shown in FIGS. 4A and 5A) out of an insulating compound such as light plastic or polystyrene with a good surface finish. The electrical performance will be achieved by metalizing the surface through electro-less or conductive paint. The thin metal deposit will be electroplated to an appropriate thickness based on the frequency of operation.

Figure 6A:
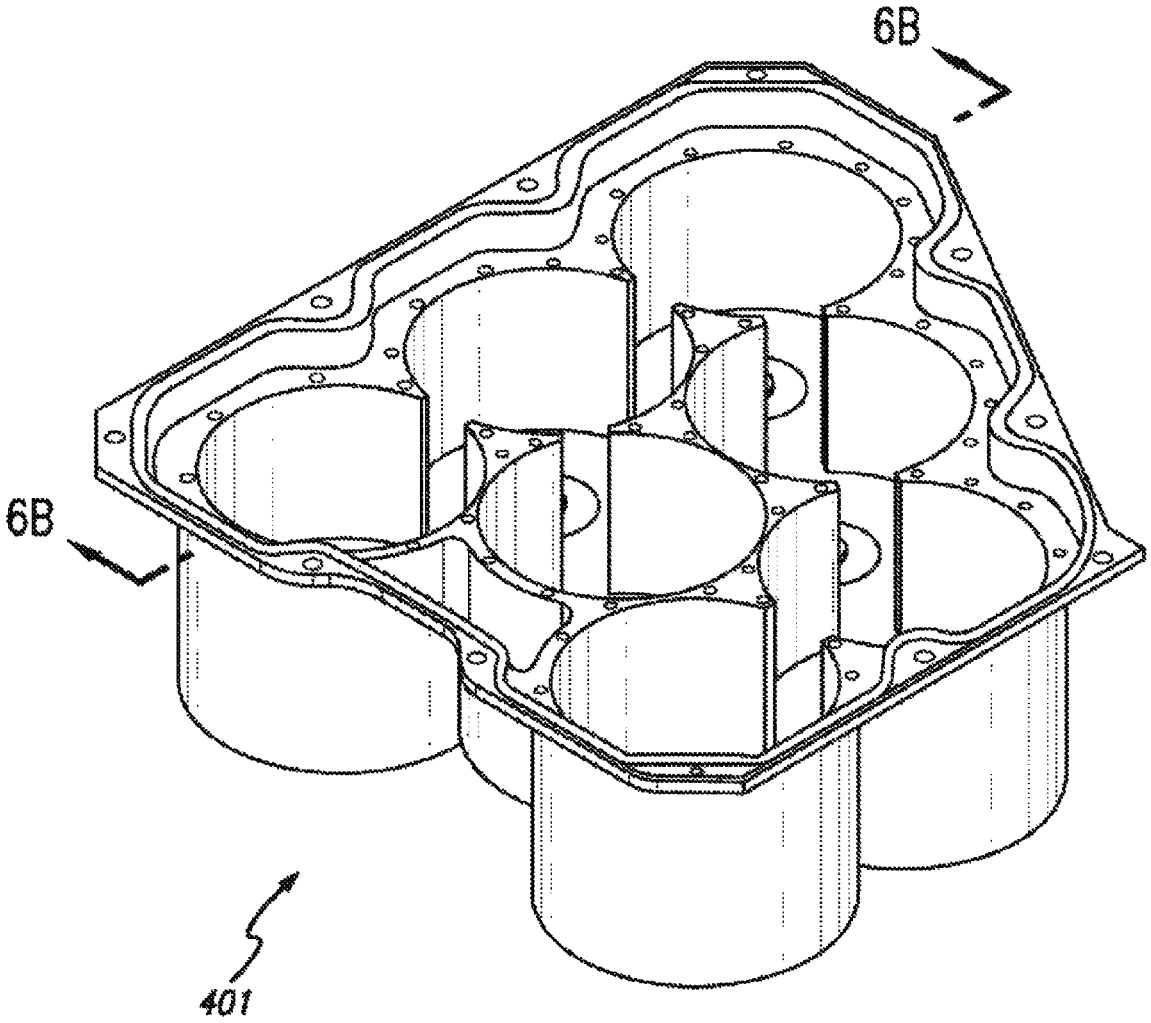
FIG. 6A is a top, perspective view of a housing having the shape and contours of a cavity filter structure.
Figure 6B:
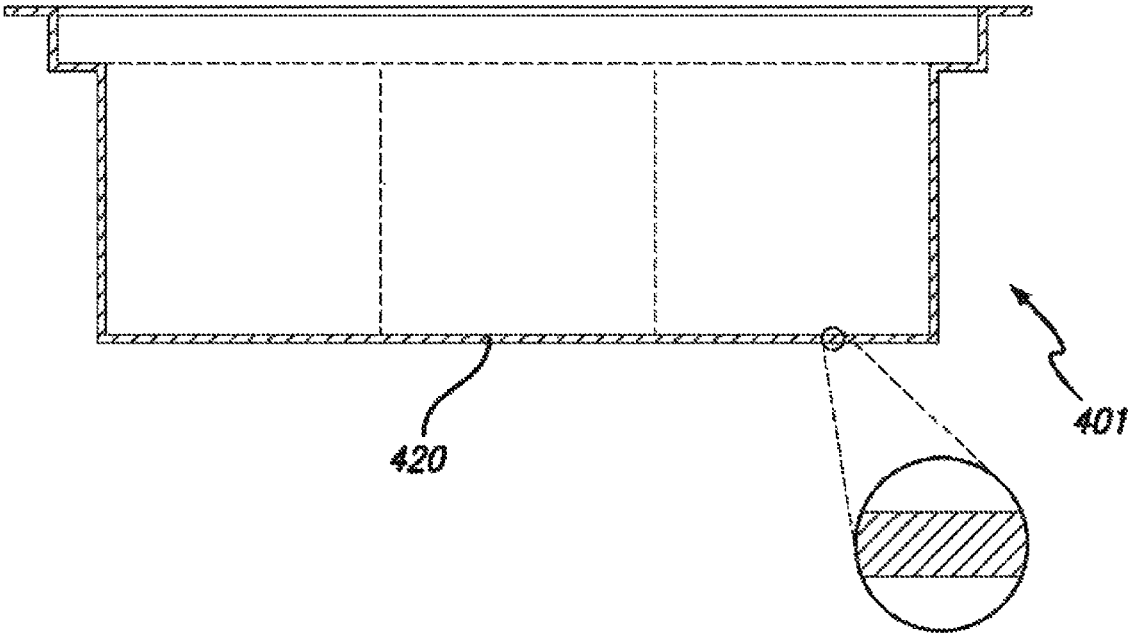
FIG. 6B is a cross-sectional view of the housing.

FIG. 6A is a top, perspective view of a housing 401 having the shape and contours of a cavity filter structure. The housing 401 may be formed out of a thin, insulating material which provides sufficient mechanical rigidity with minimal weight. Examples of insulating materials may include light-weight plastics such as, but not limited to, polystyrene. Additional braces and walls may be formed on the housing 401 for additional mechanical support. FIG. 6B depicts a cross-sectional view of the housing 401 in an embodiment, and further illustrates that insulating material 420 is much thinner than that of conventional structures.

Figure 6C:
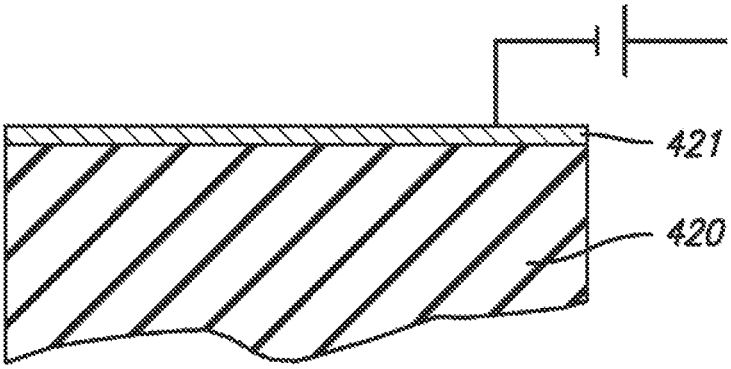
FIG. 6C is a representation of a cross-sectional view depicting an electro-less metal deposited on the surface of the housing.
Figure 6D:
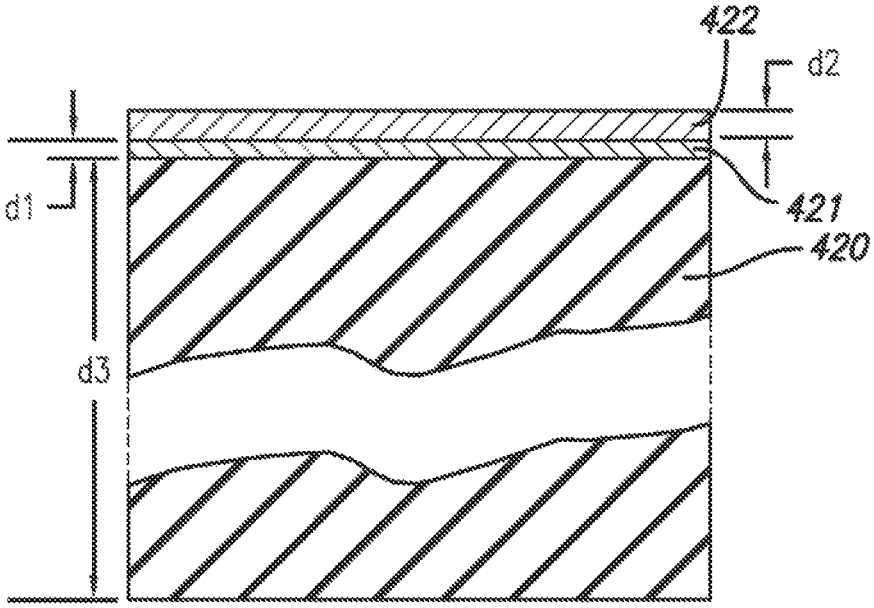
FIG. 6D is a representation of a cross-sectional view of electroplated metal deposited on the electro-less deposited metal.
Figure 6E:
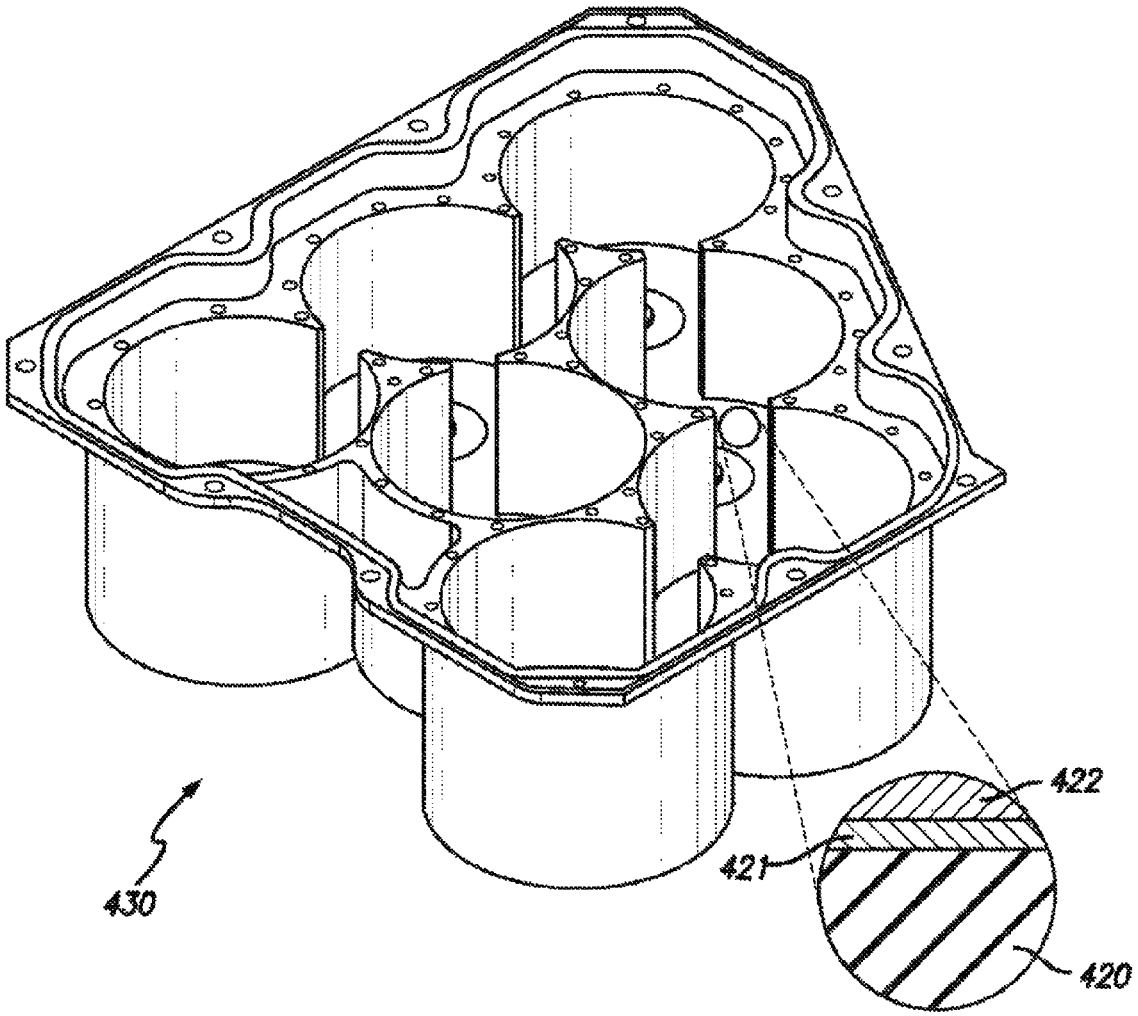
FIG. 6E is a top, perspective view of the resulting cavity filter structure.

A layer of electro-less deposited metal 421 is deposited on the insulating material 420 as discussed above and shown in FIG. 6C. This layer of electro-less deposited metal 421 may be coupled to a voltage potential to form a cathode in an electroplating process. The resulting cross-section of the electro-plated metal layer 422 deposited to the layer of electro-less metal is shown in FIG. 6D. As a result, the housing 401 now has contoured metal structure which exhibit properties of a conventional cavity filter but at a fraction of the overall weight. FIG. 6E depicts the final cavity filter structure 430. In an embodiment, insulating material 420 may be removed and other structural components may be coupled to the electro-less deposited metal.

As shown in FIG. 6D, the electro-less deposited metal 421 has a thickness represented as $d_1$, electroplated metal 422 has a thickness represented as $d_2$ and the housing insulating material 420 has a thickness represented as $d_3$. The thickness $d_1$ may be in a range approximately from a fraction of a micrometer to several micrometers and the thickness $d_2$ may be approximately in a range from a fraction of a micrometer to several micrometers in an embodiment. The total thickness of the electro-less metal 421 and the electroplated metal 422 $d_2$ (i.e., $d_1+d_2$) may be on the order of at least one to several times the skin depth associated with the operating radio frequency of the cavity filter structure in one or more embodiments and may be approximately 10 micrometers in an embodiment. The total thickness $d_3$ of the housing insulating material 420 is sufficient to provide mechanical rigidity to the electro-less deposited metal 321 and the electroplated metal 322 and may approximately one to several millimeters in an embodiment.

An embodiment provides related mechanical reinforcement of the electro-deposited filter shell. The ultra light filter structure formed by electroplating may suffer from insufficient mechanical rigidity. The structure is then filled by reinforcing foam. A variety of filler options are available for this task. This embodiment is not limited to a filler material and other metal or non-metal reinforcement structures are also claimed.

An embodiment provides the provision of reinforcing the plated cavity structure by insertion of a reinforcement structure before the plating. The reinforcing structure can be fused with the electrodeposited structure, adding mechanical strength and stability.

An embodiment relates to the method of reinforcing the overall structure by adding, welding, or brazing additional plates or laminates to the structure to achieve mechanical strength while minimizing the added weight.

An embodiment of invention extends the application of technique described above to other radio subsystems such as antennas, antenna array structures, integrated antenna array-filter/duplexer structures and active antenna arrays.

The foregoing descriptions of preferred embodiments of the invention are purely illustrative and are not meant to be limiting in nature. Those skilled in the art will appreciate that a variety of modifications are possible while remaining within the scope of the present invention.

The present invention has been described primarily as methods and structures for fabricating lightweight cavity filter structures. In this regard, the methods and structures for fabricating lightweight cavity filter structures are presented for purposes of illustration and description. Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. A lightweight radio frequency electrical structure, comprising:

a conductor structure having an exposed contoured surface shaped to a surface of a circuit structure that is associated with an operating radio frequency; and a rigid conformal mechanical support structure attached to the conductor structure, wherein the conductor structure comprises at least one conductor layer, with a first conductor layer comprising conductive paint, and wherein the conductor structure further comprises at least one of electro-less deposited material and electroplated material, with the electro-less deposited material and the electroplated material each comprising one of a metal and a metal alloy.

2. The electrical structure of claim 1 wherein a total thickness of the conductor structure is one to several times a skin depth associated with the operating radio frequency.

3. The electrical structure of claim 1 where a total thickness of the conductor structure is approximately ten micrometers.

4. The electrical structure of claim 1 wherein each conductor layer has a thickness in the range of less than one micrometer to several micrometers.

5. The electrical structure of claim 1 wherein the conductor structure comprises a copper layer covered by a silver layer.

6. The electrical structure of claim 1 wherein the circuit structure comprises one of an antenna, an antenna array, an active antenna array, an antenna array combined with a filter/duplexer, and a cavity resonator filter.

7. The electrical structure of claim 1 wherein the support structure further comprises one of braces, walls, and plates.

8. The electrical structure of claim 1 wherein the support structure comprises a reinforcing foam filling the conductor structure.

9. The electrical structure of claim 1 wherein the support structure comprises a laminate structure comprising multiple adjacent layers each comprising at least one of a metal, a metal alloy, an insulator, and a metal alloy interspersed with insulators, and wherein each layer of the laminate structure has a thermal expansion coefficient with an opposite sign than that of an adjacent layer of the laminate structure.

10. The electrical structure of claim 1 wherein the support structure comprises an insulated housing comprising one of a light plastic and polystyrene.

11. The electrical structure of claim 1 wherein the support structure has a total thickness in the range of one to several millimeters.

12. A lightweight radio frequency electrical structure produced by a process comprising the steps of:

providing a mold having a contoured surface inversely shaped to a surface of a circuit structure that is associated with an operating radio frequency, depositing a conformal first conductor layer onto the mold, the first conductor layer comprising conductive paint;

depositing at least a second conductor layer onto the first conductor layer employing an electroplating process;

depositing one or more layers of laminate onto the conductor layers, wherein the one or more layers of laminate is adapted for providing conformal mechanical support to the conductor layers; and separating the conductor layers from the mold to provide the electrical structure.

13. The electrical structure produced by the process set out in claim 12 wherein the circuit structure comprises one of an antenna, an antenna array, an active antenna array, an antenna array combined with a filter/duplexer, and a cavity resonator filter.

14. The electrical structure produced by the process set out in claim 12 whereby a total conductor layer thickness of one to several times a skin depth associated with the operating radio frequency provides a reduced total conductor layer thickness compared with machined or cast structures without affecting electrical characteristics of resonator Q-factors or transmission coefficients.

15. The electrical structure produced by the process set out in claim 12, wherein the process further comprises one of welding and brazing at least one of plates and laminates to the electrical structure.

16. A lightweight radio frequency electrical structure produced by a process comprising the steps of:

providing a rigid insulated housing having a contoured surface shaped to a surface of a circuit structure that is associated with an operating radio frequency;

depositing a conformal first conductor layer onto the housing, the first conductor layer comprising conductive paint; and depositing at least a second conductor layer onto the first conductor layer employing an electroplating process.

17. The electrical structure of claim 16 wherein the circuit structure comprises one of an antenna, an antenna array, an active antenna array, an antenna array combined with a filter/duplexer, and a cavity resonator filter.

18. The electrical structure produced by the process set out in claim 16, whereby a total conductor thickness of one to several times a skin depth associated with the operating radio frequency provides a reduced total conductor thickness compared with machined or cast structures without affecting electrical characteristics of resonator Q-factors or transmission coefficients.

19. The electrical structure produced by the process set out in claim 16, wherein the process further comprises one of welding and brazing at least one of plates and laminates to the electrical structure.

* * * * *